US005718592A

United States Patent [19]

Hosler, Sr. et al.

[11] Patent Number: 5,718,592

[45] **Date of Patent: *Feb. 17, 1998**

[54] SURFACE MOUNTABLE ELECTRICAL CONNECTOR ASSEMBLEY

[75] Inventors: Robert Craig Hosler, Sr., Marysville; Andrew James Graff, Harrisburg; Robert Leroy Fisher, Jr., Palmyra, all of Pa.

[73] Assignee: The Whitaker Corporation, Wilmington, Del.

[21] Appl. No.: 748,326

[22] Filed: Nov. 13, 1996

Related U.S. Application Data

[60] Provisional application No. 60/006,823 Nov. 16, 1995.

[51] Int. Cl.[6] ..... H01R 9/09

[52] U.S. Cl. ..... 439/63; 439/83

[58] Field of Search ..... 439/63, 74, 83, 439/581

[56] References Cited

U.S. PATENT DOCUMENTS

| | | | |
|---|---|---|---|
| 4,946,392 | 8/1990 | Kobler et al. | 439/63 |
| 5,055,068 | 10/1991 | Machura et al. | 439/581 |
| 5,078,621 | 1/1992 | Nishikawa et al. | 439/581 |
| 5,123,863 | 6/1992 | Frederick et al. | 439/578 |
| 5,133,676 | 7/1992 | Hutchison et al. | 439/581 |
| 5,180,315 | 1/1993 | Nagashima | 439/581 |
| 5,190,474 | 3/1993 | Ginet | 439/581 |
| 5,199,887 | 4/1993 | Iacono | 439/581 |
| 5,234,353 | 8/1993 | Scholz et al. | 439/289 |
| 5,322,453 | 6/1994 | Resnick et al. | 439/581 |
| 5,334,050 | 8/1994 | Andrews | 439/579 |
| 5,336,112 | 8/1994 | Michishita et al. | 439/581 |
| 5,380,211 | 1/1995 | Kawaguchi et al. | 439/74 |

FOREIGN PATENT DOCUMENTS

0617487A1 9/1994 European Pat. Off. ..... H01R 23/68

OTHER PUBLICATIONS

Evolving Telecom Products Demand Adaptations in Connectors; pp. 44–47; 2209 JEE Journal of Electronic Engineering 30 (1993) December, No. 324, vol. 30, Tokyo, JP.

GS–Steckverbinder Fur Gemischte Kontaktbestucking; pp. 4–7; Otto Blum; Bauteile Report Siemens vol. 14, No. 1, Feb. 1976, Munchen.

International Search Report; PCT/US96/18395; International Filing Date 18/11/1996; (Attorney's Docket 16285PCT).

*Primary Examiner*—Neil Abrams
*Assistant Examiner*—T. C. Patel
*Attorney, Agent, or Firm*—Katherine A. Nelson

[57] ABSTRACT

A surface mountable electrical connector (20) includes an insulating housing (22) having a coaxial subassembly receiving cavity (54) extending thereinto to a cavity bottom (56) proximate the mounting face (28); a coaxial subassembly 60) having center and outer conductors (66, 76); and first and second contacts (82, 92) along the mounting face and extending into the housing to resilient inner ends (84, 94) exposed proximate the cavity bottom. The resilient inner ends are engaged by portions of the center and outer conductors (66, 76) at the insertion end of the coaxial subassembly (60) upon full insertion into the cavity. The first and second contacts (82, 92) include outer contact sections (88, 98) adapted to be surface mounted to a circuit board. The arrangement incorporates a coaxial contact into a multiple contact hybrid connector (20) fully surface mountable to a circuit board.

9 Claims, 7 Drawing Sheets

SURFACE MOUNTABLE ELECTRICAL CONNECTOR ASSEMBLEY

This application claims the benefit of U.S. Provisional Application(s) No(s). 60/006,823, Filed Nov. 16, 1995.

FIELD OF THE INVENTION

This invention relates to the field of electrical connectors and more particularly to surface mountable connectors.

BACKGROUND OF THE INVENTION

Connectors that provide an array of signal contacts as well as coaxial contacts within common housings that are adapted to be mated together are generally referred to as hybrid connectors. The coaxial contacts contained in such housings generally are subassemblies insertable into a large cavity of the connector housing and retained therein. Each subassembly has a center or signal conductor and an outer or ground conductor concentrically disposed around the inner conductor's insulated shell. One such hybrid connector is disclosed in U.S. Pat. No. 5,234,353, which is an input/output connector.

Hybrid coaxial connectors are also used between printed circuit boards. These connectors typically have terminals that require plated through holes in the circuit board. It is desirable, however, to have hybrid coaxial connectors that are surface mounted to the board to minimize the number of holes required in a board and also to allow for higher density for the array of signal terminals.

Furthermore, it is desirable to provide a hybrid stacking coaxial connector, that is one which is connected between two parallel circuit boards, thereby allowing both low frequency signals and higher RF signals to pass from board to board via the connector.

It is also desirable to provide electrical connectors having coaxial contact subassemblies disposed in subassembly cavities therein that allow for interchangability of coaxial subassemblies having different electrical characteristics and/or mating face geometry into the same housing cavity.

SUMMARY OF THE INVENTION

The present invention is directed to a surface mountable electrical connector including an insulating housing having at least one coaxial subassembly receiving cavity extending thereinto from the mating face to a cavity bottom proximate the mounting face thereof and having a coaxial subassembly disposed therein. The coaxial subassembly has an insertion end insertable into the cavity and a mating end exposed at the mating face upon insertion into the cavity. The coaxial subassembly includes a center contact, an insulting sleeve, and an outer ground contact.

The connector further includes a first or signal contact associated with the inner or signal contact of the coaxial subassembly and at least one second or ground contact associated with the outer or ground contact of a coaxial subassembly extending from the housing along the mounting face thereof to an outer contact section that is adapted to be surface mounted to corresponding circuit pads on the surface of a circuit element, such as a circuit board or back plane. Each of the first and second contacts further includes a resilient inner contact section at an inner end thereof exposed in the subassembly cavity proximate the cavity bottom and associated with contact portions of the inner and outer subassembly contacts respectively. The inner and outer contacts of the coaxial subassembly include contact portions at the insertion end exposed to engage respective resilient inner contact sections of the first and second contacts.

Upon inserting the coaxial subassembly into the cavity, the inner and outer contacts of the subassembly engage respective inner ends of the first and second contact under spring bias to establish electrical connection therewith. In the preferred embodiment the first and second contacts are staggered along the bottom of the coaxial subassembly receiving cavity.

The present invention is further directed a surface mountable hybrid electrical connector assembly having a plug connector and a receptacle connector matable therewith, the connectors including an array of signal terminals and at least one coaxial contact subassembly surface mounted to the respective circuit boards. Each of the plug and receptacle connectors include an insulating housing having at least a first portion and a second portion. The first portion includes at least one terminal extending from a mating face to a mounting face thereof and the second portion includes at least one coaxial subassembly receiving cavity extending thereinto from the mating face to a cavity bottom proximate the mounting face and having a coaxial subassembly disposed therein. The second portion further includes first contacts associated with the inner coaxial contact and at least one second contact associated with the outer or ground coaxial contact in the manner previously described.

The invention is also directed to a cost effective method for providing an electrically low loss transition from a conventional round geometry for a coaxial contact to a flat geometry suitable for surface mounting.

The invention is further directed to an electrical connector having at least one coaxial subassembly mounted therein that is surface mountable to a circuit board.

In accordance with the invention, the plug and receptacle connectors are designed to utilize stamped and formed signal terminals, first contacts, and second contacts. The coaxial contacts are screw machined parts, as known in the art, and are secured in the housing by a press fit design.

The present invention provides a cost effective method for making a hybrid connector that is surface mountable to a circuit board.

The invention further allows for interchangability of different coaxial subassemblies having different electrical characteristics and/or mating face geometry into the same housing subassembly cavity as long as the exterior dimensions of the subassemblies remain the same.

Embodiments of the invention will now be described by way of example with reference to the accompanying drawings.

BRIEF DESCRIPTIONS OF THE DRAWINGS

DETAILED DESCRIPTION OF THE INVENTION

Figure 1:
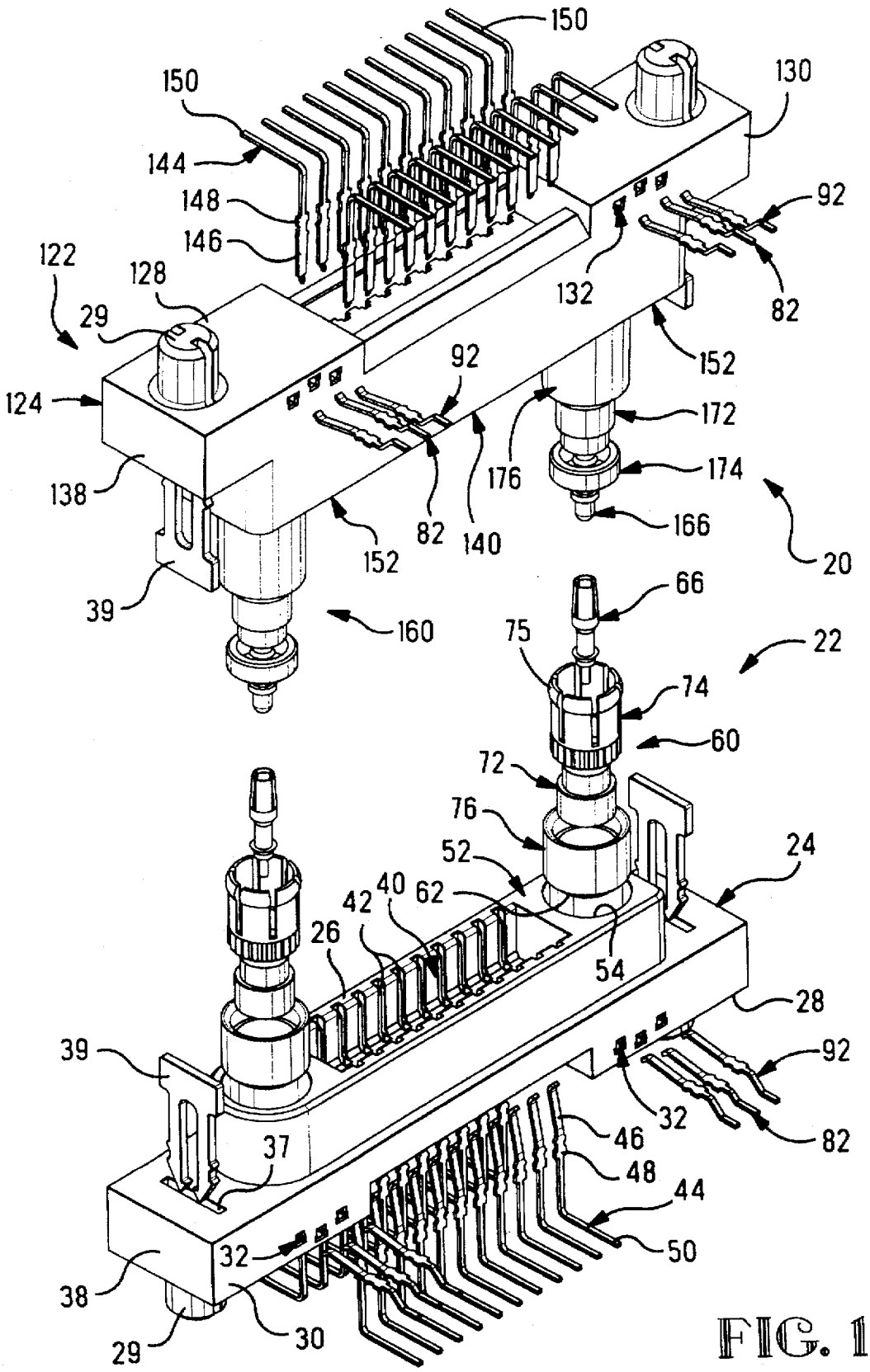
FIG. 1 is an isometric view of the hybrid connector assembly made in the accordance with the present invention with the parts exploded from each other.
Figure 2:
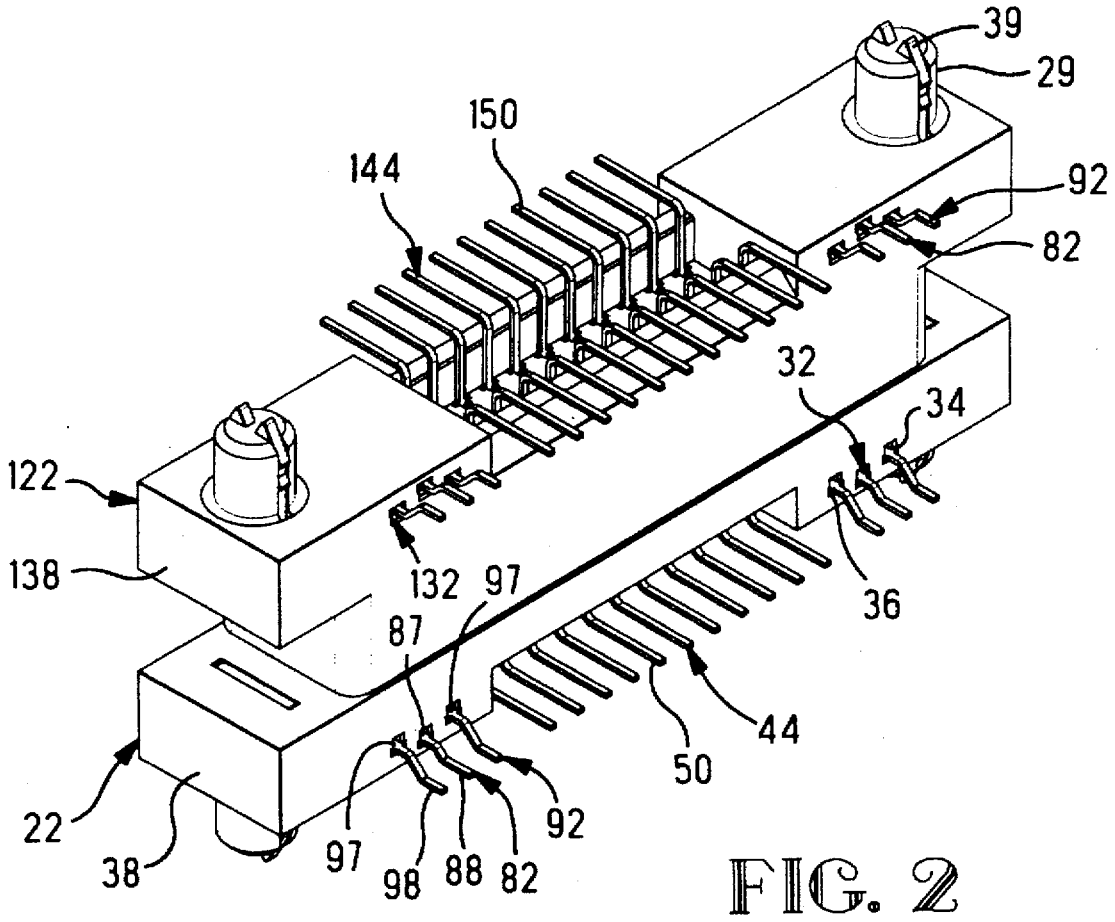
FIG. 2 is an isometric view of the mated connector assembly of FIG. 1.
Figure 3:
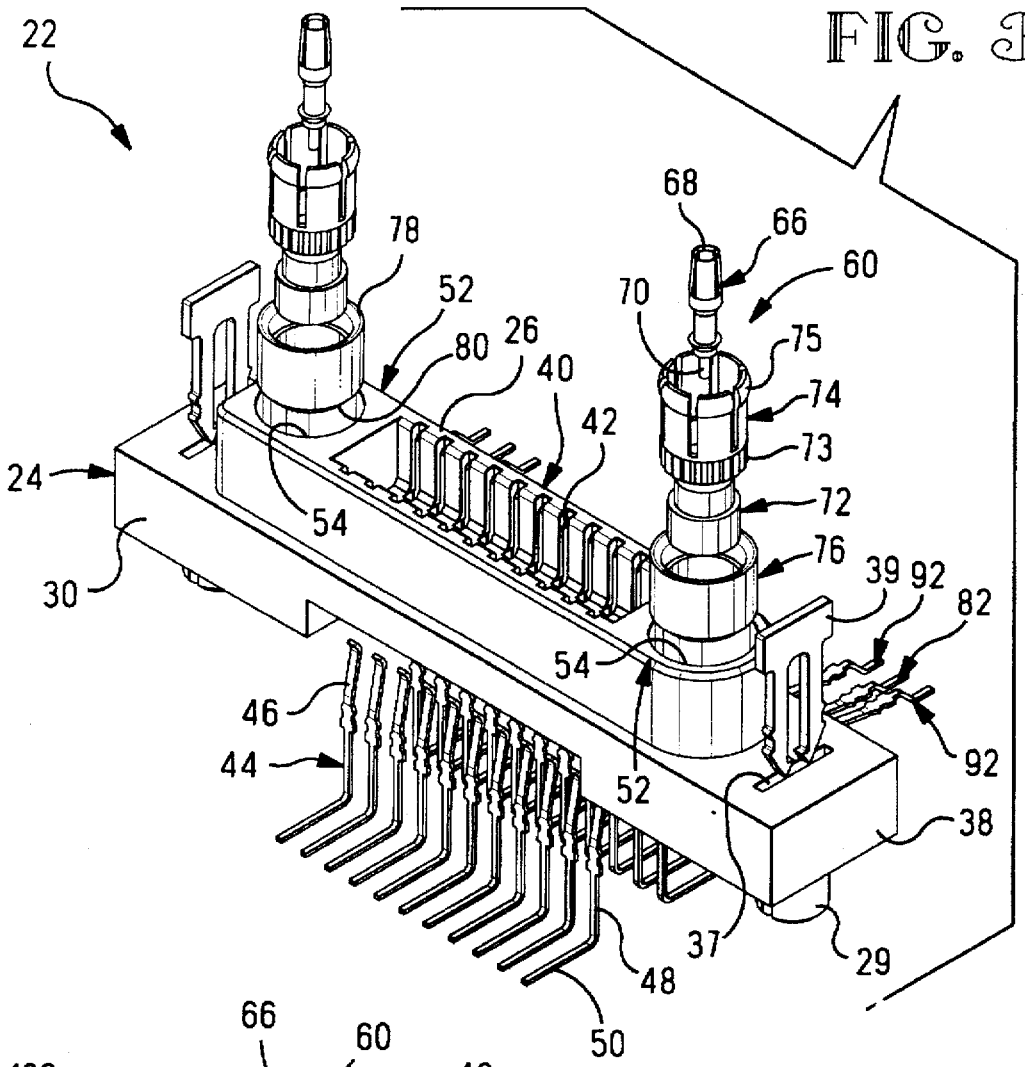
FIG. 3 is an isometric view of the receptacle connector with the parts exploded therefrom.
Figure 4:
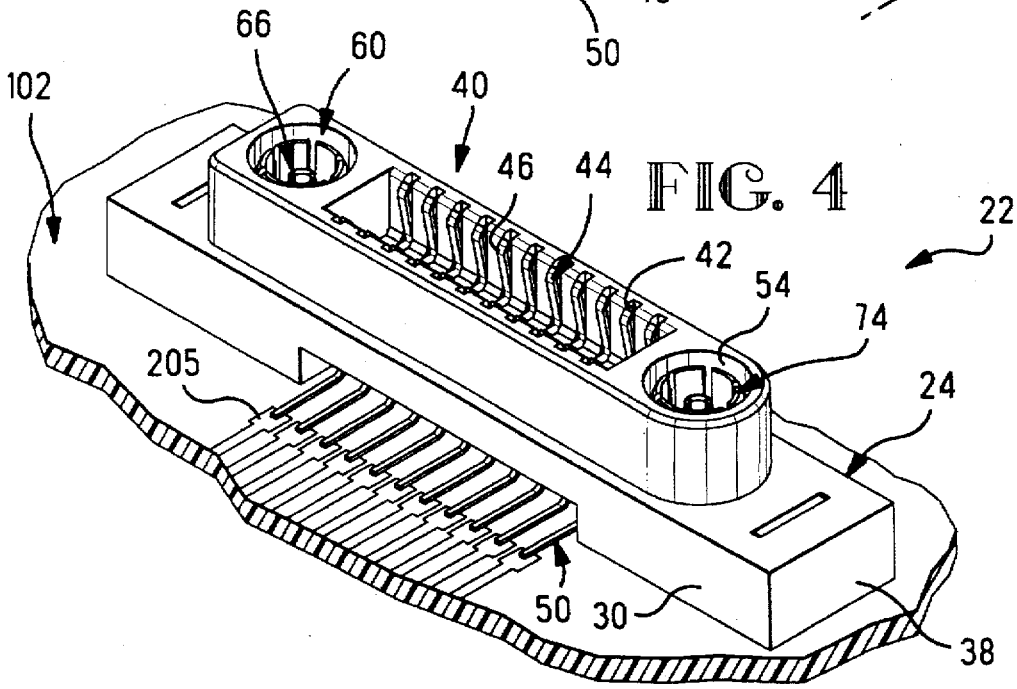
FIG. 4 is an isometric view of the assembled receptacle connector of FIG. 3 mounted to a circuit board.

For purposes of illustrating the invention, the surface mountable coaxial contact subassembly will be shown in a hybrid connector having a coaxial subassembly disposed on both sides of an array of signal terminals.

The surface mountable hybrid connector assembly 20 of the present invention includes a receptacle connector 22 and a matable plug connector 122. Receptacle connector 22 includes an array of terminals 44 disposed in a first portion 40 of the housing 24 and two coaxial contact subassemblies 60 disposed in second portions 52 of the housing 24. The plug connector 122 includes an array of signal terminals 144 disposed in the housing 124 and two coaxial subassemblies 160 disposed in second portions 152 of the housing 124.

Figure 7:
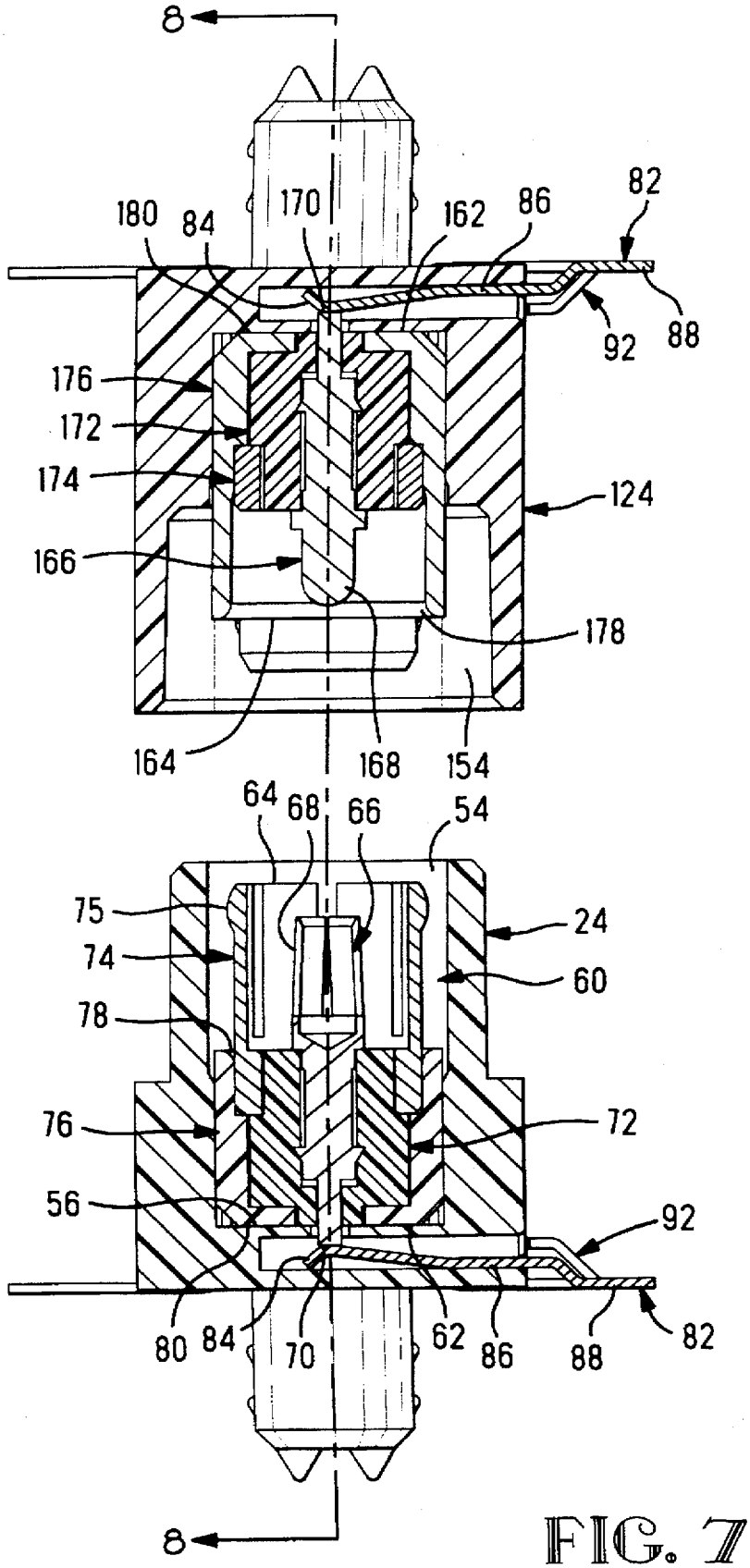
FIG. 7 is a cross-sectional view of the coaxial subassembly prior to mating taken along the line 7—7 of FIG. 8.
Figure 8:
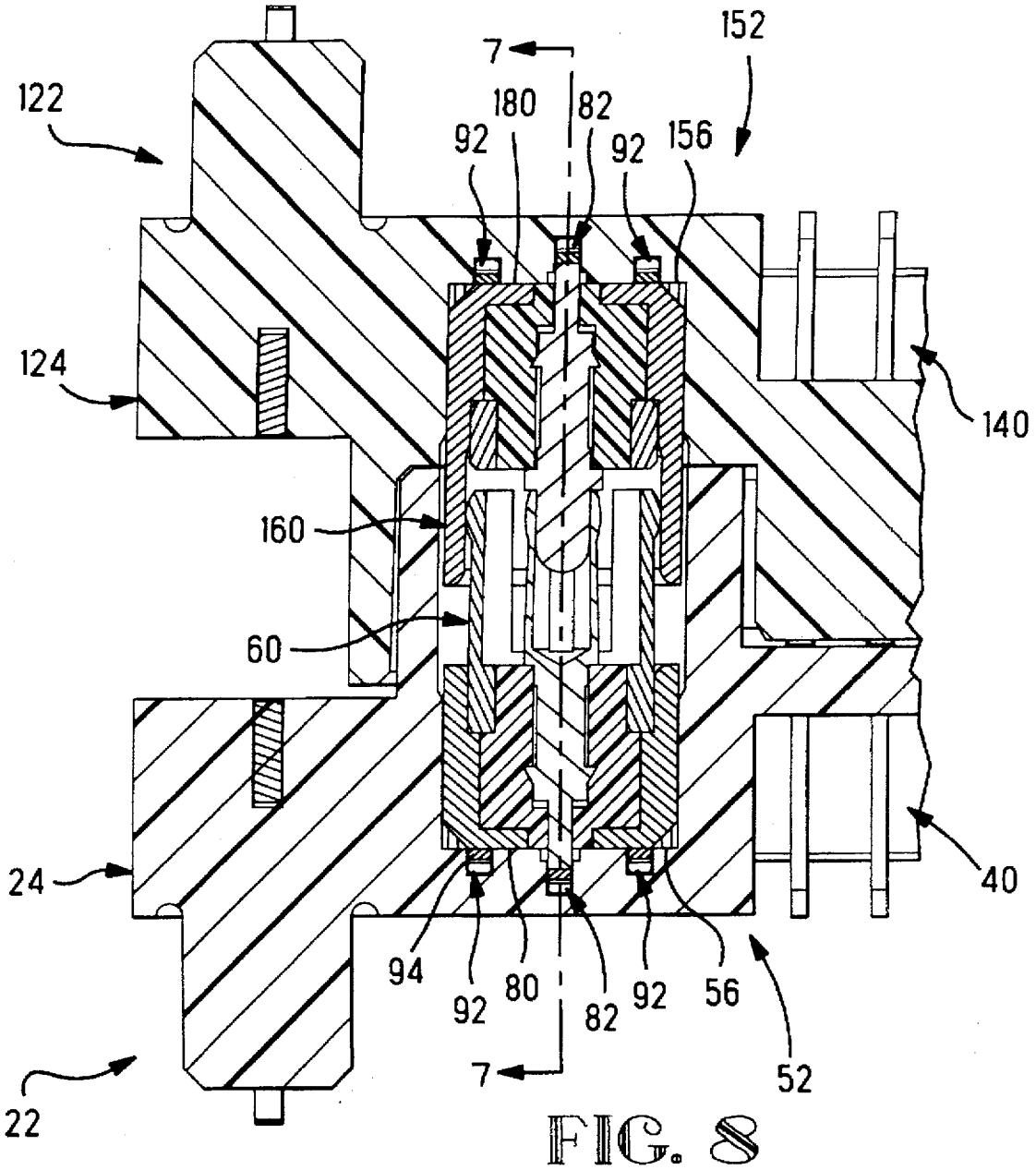
FIG. 8 is a cross-sectional view of the mated subassemblies of FIG. 7 taken along the line 8—8 of FIG. 7.

The structure of the receptacle connector 22 is best understood by referring to FIGS. 3, 4, 7 and 8. Receptacle assembly 22 includes an insulating housing 24 having opposed mating and mounting faces 26, 28, sidewalls 30 and endwalls 38. Housing 24 includes a first portion 40 and two second portions 52. First portion 40 includes a plurality of terminal receiving passageways 42 extending from the mating face 26 to the mounting face 28 and having respective terminals 44 disposed therein. First portion terminals 44 include a first connecting portion 46 exposed at the housing mating face 26, a second surface mountable connecting portion 50 exposed at the mounting face 28, and an intermediate body portion 48. Each second portion 52 includes a coaxial subassembly receiving cavity 54 extending into the housing 24 from the mating face 26 thereof to a cavity bottom 56 proximate the mating face 28, as best seen in FIGS. 7 and 8. The coaxial subassembly 60 has an insertion end 62 insertable into the cavity 54 and a mating end 64 exposed at the mating face 26 upon insertion into the cavity 54. The subassembly 60 includes a center contact 66, an insulting sleeve 72 secured around center contact 66, an outer shell 76, and a conductive outer contact 74 having a plurality of fingers 75. The outer contact 74 is disposed around the insulating sleeve 72 to secure the sleeve 72 and inner contact 66 within the coaxial subassembly 60, as best seen in FIGS. 7 and 8. The inner contact 66 includes a mating portion 68 that is exposed at the mating face 26 of the housing 24 upon inserting the subassembly 60 into the cavity 54, and an inner contact portion 70 exposed approximate the bottom of the cavity 54. The outer shell 76 includes a portion 78 exposed at the mating face 26 and an inner contact portion 80 exposed proximate the bottom of the cavity 54 upon insertion of the subassembly 60 into cavity 54.

Referring now to FIGS. 1 through 4, 7 and 8, housing sidewall 30 includes a plurality of apertures 32 extending therethrough and into the subassembly receiving cavity 54 proximate the bottom 56 thereof. The apertures 32 include narrow and wide portions 34, 36, which are adapted to receive and secure therein a first contact 82 associated with the inner contact 66 of the coaxial subassembly 60 and at least one second contact 92 associated with the outer shell 76 of the coaxial subassembly 60. The first contact 82 includes a resilient inner contact section 84, an intermediate body 86, and a surface mount outer contact section 88. The second contact 92 includes a resilient inner contact section 94, an intermediate body section 96, and surface mount outer contact section 98. Upon inserting the respective first and second contacts 82, 92 into the respective apertures 32, the inner ends 84, 94 extend into the subassembly cavity 54 at the bottom 56 thereof such that the contact portions are exposed to engage corresponding inner signal and outer ground contact sections 70, 80 respectively, as best seen in FIGS. 7 and 8.

Upon inserting the coaxial subassembly 60 into the cavity 54, the inner contact portions 70, 80 of the inner and outer contact 66, 76 respectively engage the respective inner ends 84, 94 of the first and second contacts 82, 92 under spring bias to establish electrical connection therewith, as shown in FIGS. 7 and 8. In the preferred embodiment, two second contacts 92 are provided for the coaxial subassembly 60 for connection to ground pads (not shown) of a circuit board to isolate the first contact 82, which is connected to a signal pad (not shown) on circuit board 102. This is particularly desirable when an impedance matched coaxial subassembly is used.

Figure 5:
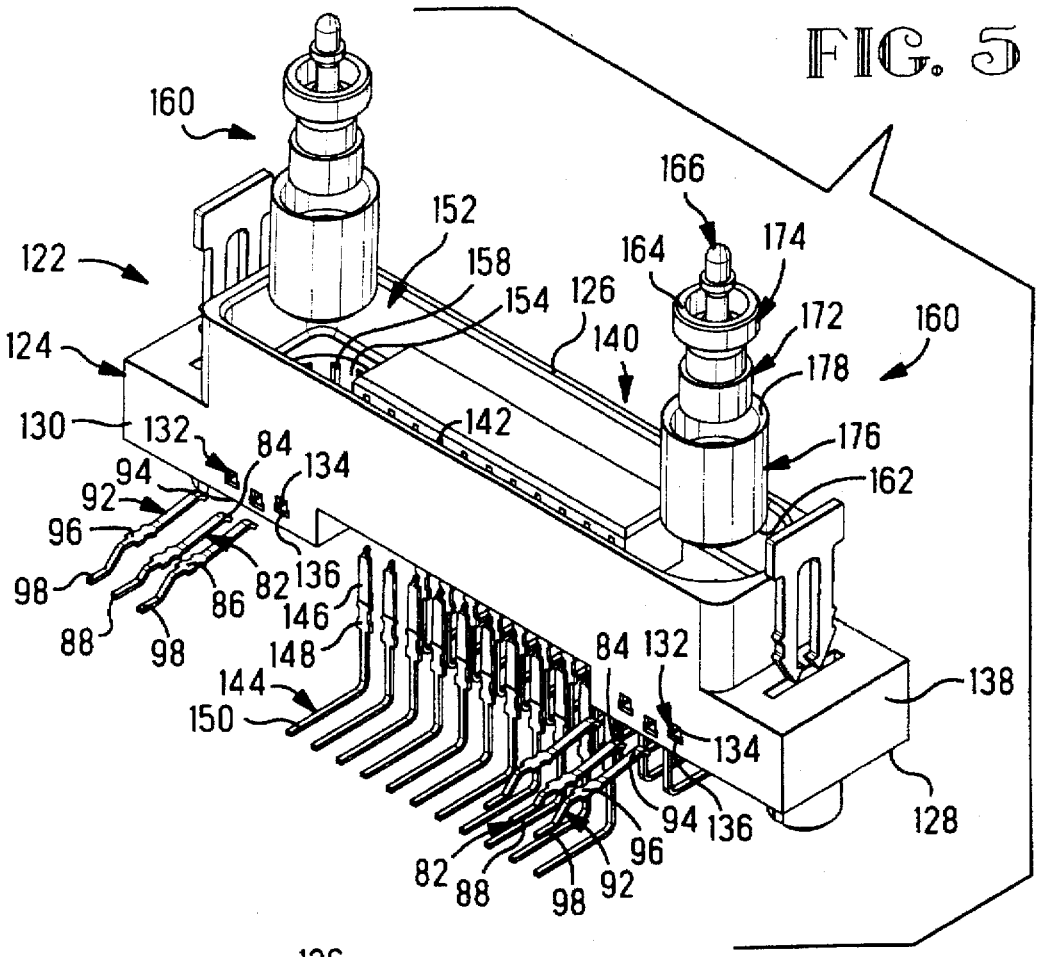
FIG. 5 is an isometric view of the plug connector with the parts exploded therefrom.

Referring now to FIGS. 5, 6, 7 and 8, plug connector 122 includes an insulating housing 124 having opposed mating and mounting faces 126, 128, sidewalls 130, and endwalls 138. Housing 124 includes a first portion 140 and two second portions 152. First portion 140 includes a plurality of terminal receiving passageways 142 extending from the mating face 126 to the mounting face 128 and having respective terminals 144 disposed therein. First portion terminals 144 include a first connecting portion 146 exposed at the housing mating face 126, a second surface mountable connecting portion 150 exposed at the mounting face 128, and an intermediate body portion 148. Each second portion 152 includes a coaxial subassembly receiving cavity 154 extending into the housing 124 from the mating face 126 thereof to a cavity bottom 156 proximate the mounting face 128, as best seen in FIGS. 7 and 8. As can be seen in FIG. 5, subassembly receiving cavity 154 includes a plurality of ribs 158 that secure subassembly 160 in the cavity in a press or interference fit. The coaxial subassembly 160 has an insertion end 162 insertable into the cavity 154 and a mating end 164 exposed at the mating face 126 upon insertion into the cavity 154. The subassembly 160 includes a center contact 166, an insulting sleeve 172 disposed around center contact 166, and an outer or ground shell 176. A conductive retention ring 174 is disposed around the insulating sleeve 172 to secure the sleeve 172 and inner contact 166 within the coaxial subassembly 160, as best seen in Figures in 7 and 8. The inner contact 166 includes a mating portion 168 that is exposed at the mating face 126 of the housing 124 upon inserting the subassembly 160 into the cavity 154 and an inner contact portion 170 exposed proximate the bottom of the cavity 154. The outer shell 176 includes a portion 178 exposed at the mating face 126 and an inner contact portion 180 exposed proximate the bottom of the cavity 154 upon insertion of the subassembly 160 into cavity 154.

Figure 6:
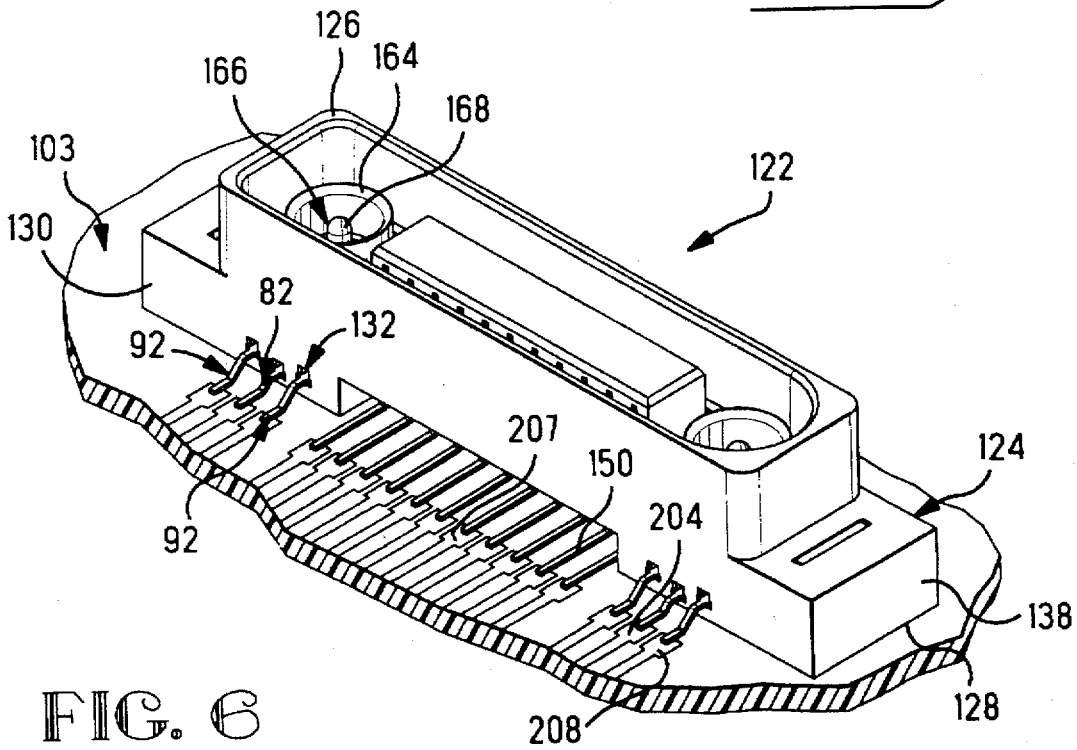
FIG. 6 is an isometric assembled view of the plug connector of FIG. 5 mounted to a circuit board.

Referring now to FIGS. 1, 2, and 5 through 8, housing sidewall 130 includes a plurality of apertures 132 extending therethrough and into the subassembly receiving cavity 154 proximate the bottom 156 thereof, in the manner previously described. The apertures 132 include narrow and wide sections 134, 136 that are adapted to receive and secure therein a first contact 82 associated with the inner contact 166 of the coaxial subassembly 160 and at least one second contact 92 associated with the outer shell 176 of the coaxial subassembly 160. Upon inserting the respective first and second contacts 82, 92 into the respective apertures 132, the inner ends 84, 94 extend into the subassembly cavity 154 at the bottom 156 thereof and engage the inner contact portions 170, 180 of the inner and outer contact 166, 176 respectively under spring bias to establish electrical connection therewith as previously described and as shown in FIGS. 7 and 8. In the preferred embodiment, two second contacts 92 are provided for the coaxial subassembly 160. As shown in FIG. 6, first contacts 82 are electrically connected with signal pad 204 on a circuit board and second contacts 92 are electrically connected with ground pads 208 thereon. The array of signal terminals are connected to pads 207.

Figure 9:
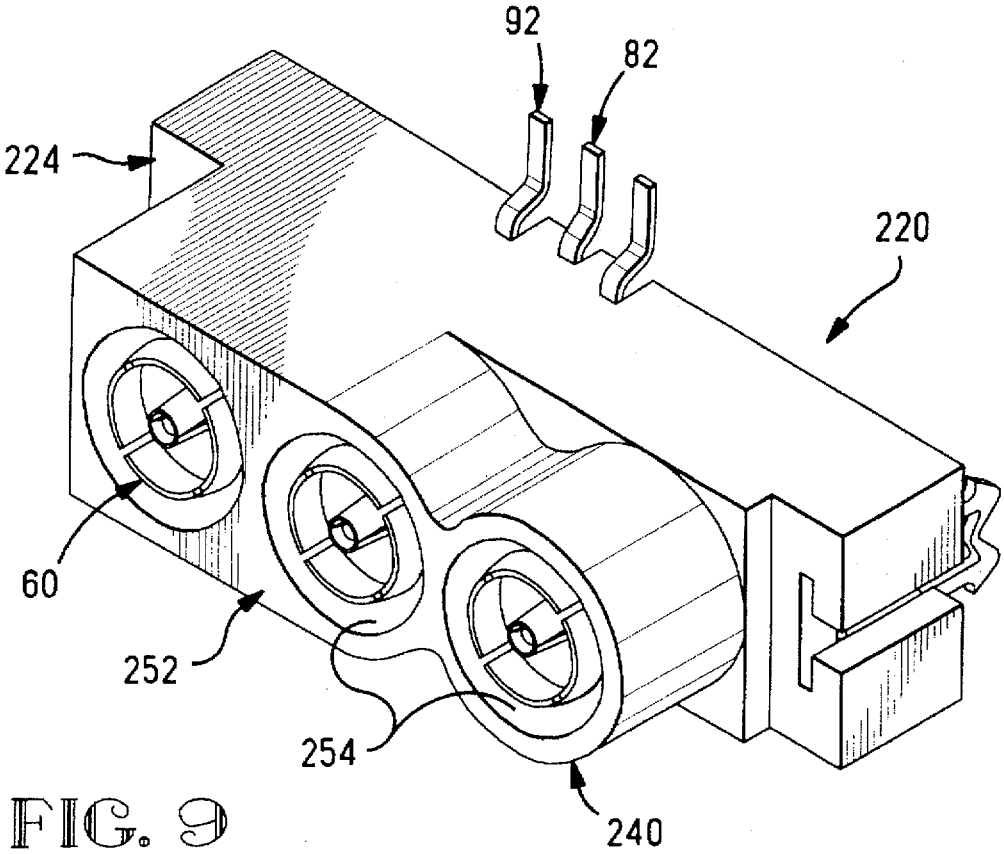
FIG. 9 is an isometric view of an alternative embodiment of the coaxial connector of the present invention.
Figure 10:
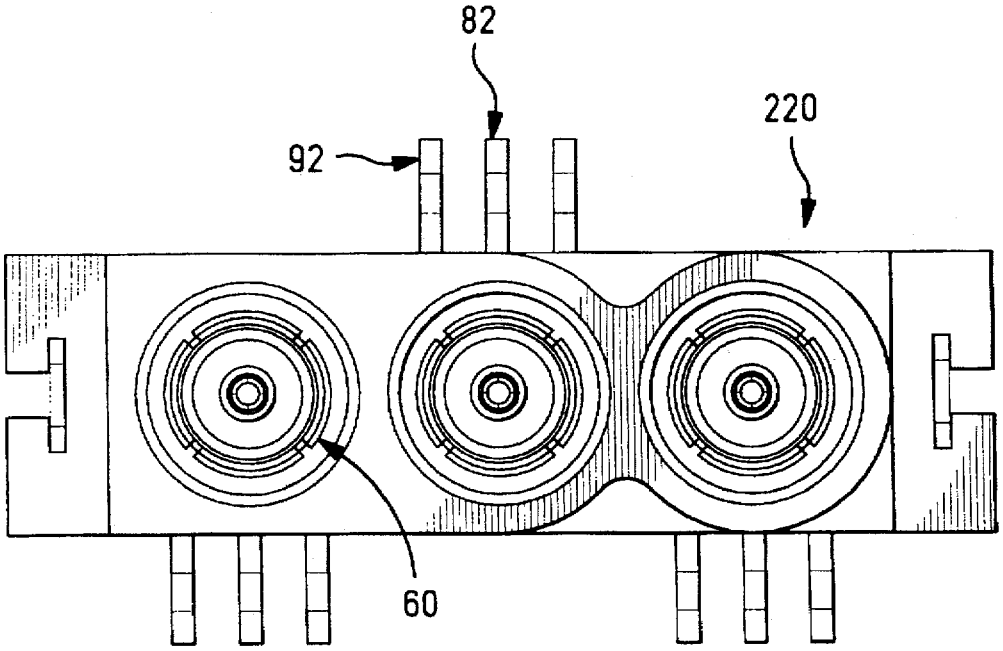
FIG. 10 is a top plan view of the connector of FIG. 9.

FIGS. 9 and 10 show an alternative embodiment 220 of the present invention having a plurality of coaxial subassemblies 60 disposed in respective subassembly cavities 254 of housing 224. As can be seen from these Figures, the first and second contacts 82, 92 engage with the respective ones of the inner or signal and outer or ground contacts of the respective subassemblies 60 and preferably extend from opposite sides of the housing 224.

The present invention has the advantage of utilizing standard stamped and formed signal terminals for the terminal array in the first portion of the housing and stamped and formed first and second contacts for engaging the respective contacts in the coaxial subassemblies. The inner and outer contacts of the coaxial contacts are screw machined parts made from suitable materials as known in the art, to achieve the desired mechanical and electrical characteristics. The housing is preferably molded from a high temperature plastic that can withstand the soldering temperatures associated with surface mounting contacts to a circuit board.

In addition, the invention provides a cost effective method for establishing an electrically low loss transition from a conventional round geometry for a coaxial contact to a flat geometry suitable for surface mounting. The invention further allows for the interchangability of different coaxial subassemblies having different electrical characteristics and/or mating face geometry into the same housing subassembly cavity as long as the exterior dimensions of the subassemblies remain the same. Thus, a manufacturer has the ability to customize connectors for different end users in a cost effective manner.

It is thought that the surface mountable coaxial connector of the present invention and many of its attendant advantages will be understood from the foregoing description. It is apparent that various changes may be made in the form, construction, and arrangement of part thereof without departing from the spirit or scope of the invention or sacrificing all its material advantages.

We claim:

1. A surface mountable electrical connector comprising:

an insulating housing having at least one coaxial subassembly receiving cavity extending thereinto from a mating face of said housing to a cavity bottom proximate a mounting face thereof;

a coaxial subassembly having an insertion end insertable into said at least one cavity, and having a mating end exposed at said mating face upon insertion into said cavity, said subassembly including a center contact, an insulating sleeve and an outer ground contact;

a first contact associated with said center contact of said coaxial subassembly and at least one second contact associated with said outer ground contact of said coaxial subassembly, each of said first and at least one second contacts extending from the housing along the mounting face thereof to an outer contact section adapted to be surface mounted to corresponding circuit pads on a surface of a circuit element;

each of said first contact and said at least one second contact further including a resilient inner contact section at an inner end exposed in said subassembly cavity proximate said cavity bottom and associated with contact portions of said center and outer ground contacts respectively; and said center and outer ground contacts of said coaxial subassembly having contact portions at said insertion end exposed to engage said first and second contact inner contact sections;

whereby upon inserting said coaxial subassembly into said cavity said inner and outer contacts of said subassembly engage respective inner ends of said first and second contacts under spring bias to establish electrical connection therewith.

2. The connector of claim 1 wherein said first and second contacts are staggered along said coaxial subassembly receiving cavity.

3. A surface mountable electrical connector comprising:

an insulating housing having at least a first portion and a second portion;

said first portion including at least one terminal extending from a mating face to a mounting face;

said second portion including at least one coaxial subassembly receiving cavity extending thereinto from the mating face of said housing to a cavity bottom proximate said mounting face;

at least one coaxial subassembly, each subassembly having an insertion end insertable into respective said cavity and having a mating end exposed at said mating face upon insertion into said cavity, each said subassembly including a center contact, an insulating sleeve, and an outer ground contact;

a first contact associated with said center contact of each said coaxial subassembly and at least one second contact associated with said outer contact of each said coaxial subassembly, each of said first and at least one second contacts extending from the housing along the mounting face thereof to an outer contact section adapted to be surface mounted to corresponding circuit pads on a surface of a circuit element; each of said first contact and said at least one second contact further including a resilient inner contact section at an inner end exposed in said respective subassembly cavity proximate said cavity bottom and associated with contact portions of said center and outer subassembly contacts respectively; and said inner and outer ground contacts of each said coaxial subassembly having contact portions at said insertion end exposed to engage said first and second contact inner contact sections;

whereby upon inserting each said coaxial subassembly into said respective cavity said inner and outer contacts of each said subassembly engage respective inner ends of said first and second contacts under spring bias to establish electrical connection therewith.

4. The connector of claim 3 wherein said first and second contacts are staggered along said coaxial subassembly receiving cavity.

5. The connector of claim 4 wherein said contact portion of said center contact of said coaxial subassembly extends further into the subassembly receiving cavity than the contact portion of the associated outer ground contact.

6. The connector of claim 3 wherein each coaxial subassembly includes two second contacts extending from the housing along the mounting face thereof, each of said second contacts engaging said subassembly outer ground contact.

7. The connector of claim 3 wherein said housing includes at least two second portions, each having at least one coaxial subassembly receiving cavity.

8. The connector of claim 3 wherein said first portion of said housing includes an array of terminals extending from said mating face to said mounting face.

9. The connector of claim 8 wherein said housing includes at least two second portions separated by at least some of said array of terminals, each second portion having at least one coaxial subassembly receiving cavity.

* * * * *